US006024079A

United States Patent [19]

Ingle et al.

[11] Patent Number: 6,024,079

[45] Date of Patent: Feb. 15, 2000

[54] REAR PEEP SIGHT

[75] Inventors: Michael Ingle; Ronald E. Wing, both of Battle Creek, Mich.

[73] Assignee: Inglewing, Inc., Battle Creek, Mich.

[21] Appl. No.: 09/229,128

[22] Filed: Jan. 12, 1999

[51] Int. Cl.[7] ..... F41G 1/467

[52] U.S. Cl. ..... 124/87; 124/90; 33/265

[58] Field of Search ..... 124/87, 90; 33/265

[56] References Cited

U.S. PATENT DOCUMENTS

| | | | |
|---|---|---|---|
| 4,656,746 | 4/1987 | Gillespie . | |
| 4,656,747 | 4/1987 | Troncoso | 33/265 |
| 4,965,938 | 10/1990 | Saunders | 33/265 |
| 4,967,478 | 11/1990 | Sherman . | |
| 5,056,498 | 10/1991 | Scherz . | |
| 5,107,596 | 4/1992 | Snyder . | |
| 5,347,976 | 9/1994 | Saunders | 124/87 |
| 5,379,748 | 1/1995 | Carlson | 124/87 |
| 5,669,146 | 9/1997 | Beutler . | |
| 5,819,423 | 10/1998 | Kamola | 33/265 |

*Primary Examiner*—John A. Ricci
*Attorney, Agent, or Firm*—Mary M. Moyne; Ian C. McLeod

[57] ABSTRACT

A rear peep sight (10) for use with a bow (100) having a bowstring (102), is described. The sight has a body (12) with a sighting member (14) extending upward and outward from a first surface (12F) of the body and an aligning post (22) extending upward and outward from a second surface (12G). The sight has grooves (12E) between the first and second surfaces to allow for mounting between the strings (104) of the bowstring. A sight opening (16) is located in the sighting member such as to be completely spaced beyond the body of the sight and the bowstring. The opening has a gap (18) along one side of the sighting member to allow additional light to enter the opening. The aligning post is connected to a tether (24) which is connected at the other end to the bow or cable (108). When the bowstring is moved into the fully drawn position, the tether becomes taut and moves the sight into the aligned position. The user aligns an arrow (106) in the bow by sighting the front sight (110) and the target through the sight opening and aligning the front sight with the target.

27 Claims, 4 Drawing Sheets

REAR PEEP SIGHT

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION (1) Field of the Invention

The present invention relates to a rear peep sight for mounting on the bowstring of an archery bow. In particular, the present invention relates to a rear peep sight which is mounted between the strings of the bowstring where the peep opening is spaced apart from the bowstrings. In addition, the present invention relates to a rear peep sight which mounts between the strings of the bowstring where the peep opening has a gap along one side such as to allow more light to enter the opening to enable the bow to be used during times of limited light.

(2) Description of the Related Art

The related art has shown various rear peep sights for mounting between the strings of a bowstring of an archery bow. Illustrative are U.S. Pat. No. 5,056,498 to Scherz and U.S. Pat. No. 5,669,146 to Beutler which show rear peep sights for mounting between the strings of the bowstring of the bow where the sighting hole or aperture is located in the center of the peep sight between the strings.

The related art has also shown rear peep sights for mounting on or around the entire bowstring which has a peep opening spaced apart from the bowstring. Illustrative are U.S. Pat. No. 4,656,746 to Gillespie and U.S. Pat. No. 5,107,596 to Snyder.

Gillespie shows a rear peep sight which is pivotably mounted on the bowstring of a bow. The bowstring extends through a cylindrical channel at the rear extremity of the frame of the sight. The sight has left and right sighting panels which extend perpendicularly outward from the left and right side panels of the frame, each sighting panel has a peep hole and a notch above the peep hole. The sighting panels are mounted on the frame at an angle to the channel. A weighted counterbalance is mounted between the side panels of the frame to cause the sight to assume a position upon the fully drawn bowstring such that the eye of the archer can sight through the peep hole or notch to align the front bowsight with the target.

Snyder shows a peep sight having a main body with a generally cylindrical configuration and a lateral bore extending between the ends. The peep sight is pivotably mounted on the bowstring such that the bowstring extends through the lateral bore of the main body. A sighting member extends from the outer sidewall of the main body situated generally perpendicular to the sidewall. A weighting member is also affixed to the outer sidewall of the main body so as to be generally perpendicular to the sighting member.

Only of minimal interest is U.S. Pat. No. 4,967,478 to Sherman which shows a front sight and a rear sight housed in a tube which is mounted to the archery bow.

There remains the need for a rear peep sight for mounting between the strings of the bowstring of an archery bow which has a sight opening which is spaced apart from the bowstring and where the sight opening has a gap along one side to allow additional light into the opening to allow the sight to be used in limited light situations.

SUMMARY OF THE INVENTION

The present invention relates to a rear peep sight for mounting between the strings of a bowstring on an archery bow. The rear peep sight has a body with grooves along each side such that the sight has a first surface on one side of the strings and a second surface on the other side of the strings. A sight member is mounted on the first surface of the body. The sight member extends outward from the body at an angle in a direction opposite the second surface of the body. The sighting member also extends outward away from the sides of the body. A sight opening is located in the sighting member. The sight opening is located so as to be spaced completely beyond the body of the sight. The positioning of the sight opening allows the line of sight through the opening to be unhindered by the body. The opening also has a gap or open space along one side of the sighting member. The gap allows additional light to enter the opening which allows the sight to be used in low lighting conditions. An aligning post is mounted on the second surface of the body. The aligning post is connected to a tether which mounts on the riser or cables. When the bowstring is moved into the fully drawn position, the tether becomes taut which causes the body of the sight to pivot and moves the sighting opening into an aligned position. The user aims the bow by looking through the opening of the rear peep sight and lining up the front sight with a target.

The substance and advantages of the present invention will become increasingly apparent by reference to the following drawings and the description.

DESCRIPTION OF THE PREFERRED EMBODIMENT(S)

Figure 1:
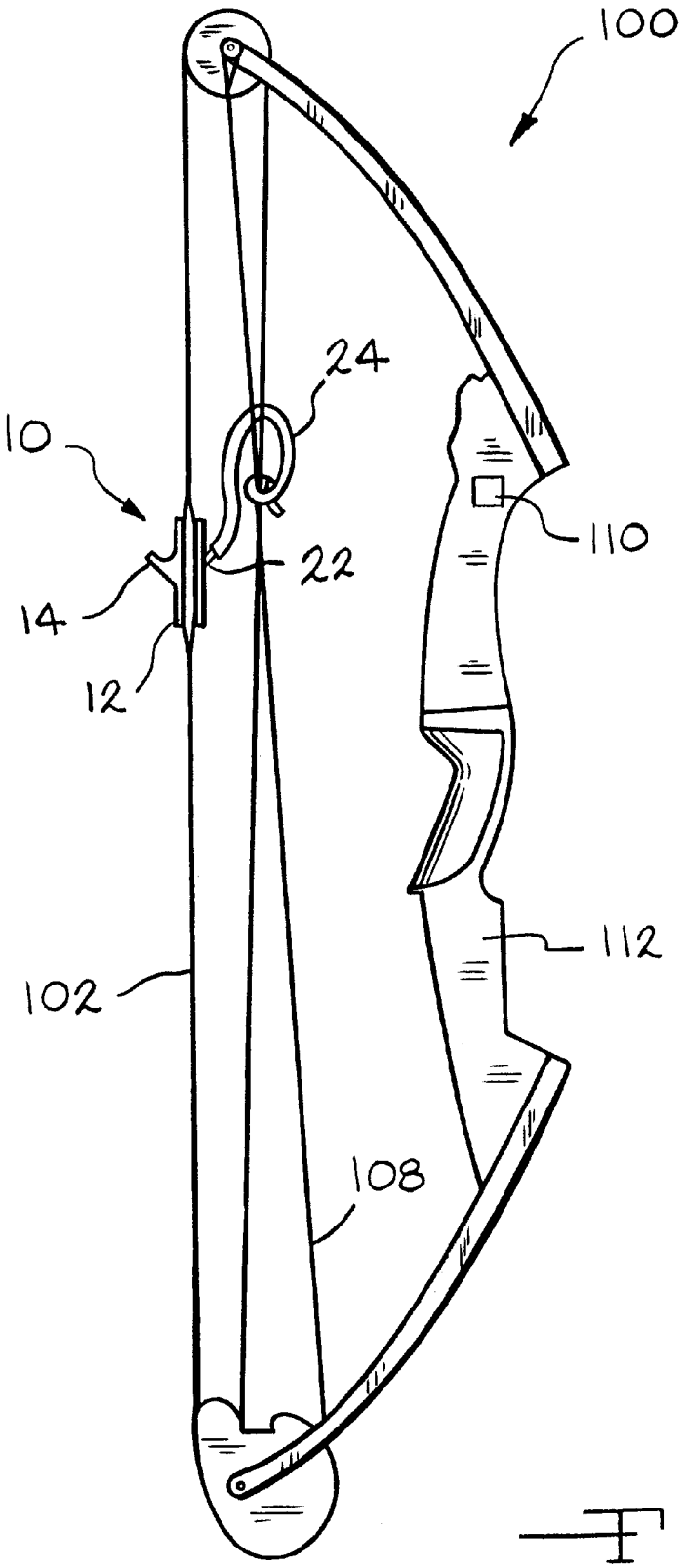
FIG. 1 is a side view of the archery bow 100 in the relaxed position showing the rear peep sight 10.

The present invention relates to a rear sight for mounting on a bowstring of an archery bow for sighting a target, which comprises: a body having opposed ends with a first side and a second side extending therebetween with a first surface and a second surface between the sides and having a mounting means for mounting the sight on the bowstring; a sighting means having opposed ends with an opening between the ends and positioned at one of the ends on the first surface of the body and extending outward at an angle away from the first surface in a direction opposite the second surface and extending outward away from the first side of the body and beyond the second side of the body such that the opening of the sighting means is beyond the second side of the body of the sight; and an alignment means located on the body for positioning the sighting means in an aligned position such that when the bow is in a fully drawn position, a line of sight is allowed through the opening in the sighting means to the target.

Further, the present invention relates to a rear sight for mounting on a bowstring of an archery bow for sighting a target, which comprises: a body having opposed ends with a first side and a second side extending therebetween with a first surface and a second surface and having a mounting means for mounting the sight on the bowstring; a sighting means having opposed ends with opposed first and second sides therebetween and positioned at one of the ends adjacent the first side of the body on the first surface of the body and extending outward toward the other end at an angle away from the first surface in a direction opposite the second surface and extending outward toward the second side of the body away from the first side of the body and beyond the second side of the body such that the second side of the sighting means is beyond the body of the sight, the sighting means having an opening with a gap adjacent the second side of the sighting means between the ends; and an alignment means located on the second surface of the body for positioning the sighting means such that when the bow is in a fully drawn position, the sides of the sighting means are perpendicular to a line of sight to the target through the opening in the sighting means.

Still further, the present invention relates to a method for accurately sighting an arrow in an archery bow with a target, the bow having a front sight mounted on a riser portion of the bow, which comprises the steps of: providing a rear sight for mounting on a bowstring of an archery bow, which comprises: a body having opposed ends with a first side and a second side extending therebetween with a first surface and a second surface between the sides and having a mounting means for mounting the sight on the bowstring; a sighting means having opposed ends with an opening between the ends and positioned at one of the ends on the first surface of the body and extending outward at an angle away from the first surface in a direction opposite the second surface and extending outward away from the first side of the body and beyond the second side of the body such that the opening of the sighting means is beyond the second side of the body of the sight; and an alignment means located on the body for positioning the sighting means in an aligned position such that a line of sight through the opening in the sighting means and the front sight to the target is allowed when the bow is in a fully drawn position; mounting the arrow in the bow such that the sighting means is positioned on the bowstring above the arrow; drawing the bowstring away from the riser portion of the bow into the fully drawn position; and aligning the arrow with the target by looking through the rear sight and aligning the front sight and the target.

Further still, the present invention relates to a method for accurately sighting an arrow in an archery bow with a target, the bow having a front sight mounted on a riser portion of the bow, which comprises the steps of: providing a rear sight for mounting on a bowstring of an archery bow, which comprises: a body having opposed ends with a first side and a second side extending therebetween with a first surface and a second surface and having a mounting means for mounting the sight on the bowstring; a sighting means having opposed ends with opposed first and second sides therebetween and positioned at one of the ends adjacent the first side of the body on the first surface of the body and extending outward toward the other end at an angle away from the first surface in a direction opposite the second surface and extending outward toward the second side of the body away from the first side of the body and beyond the second side of the body such that the second side of the sighting means is beyond the body of the sight, the sighting means having an opening with a gap adjacent the second side of the sighting means between the ends; and an alignment means located on the second surface of the body for positioning the sighting means such that when the bow is in a fully drawn position, the sides of the sighting means are perpendicular to a line of sight allowed through the opening in the sighting means and the front sight to the target; mounting the arrow in the bow such that the sighting means is positioned on the bowstring above the arrow; drawing the bowstring away from the riser portion of the bow into the fully drawn position; and aligning the arrow with the target by looking through the rear sight and aligning the front sight and the target.

Figure 3:
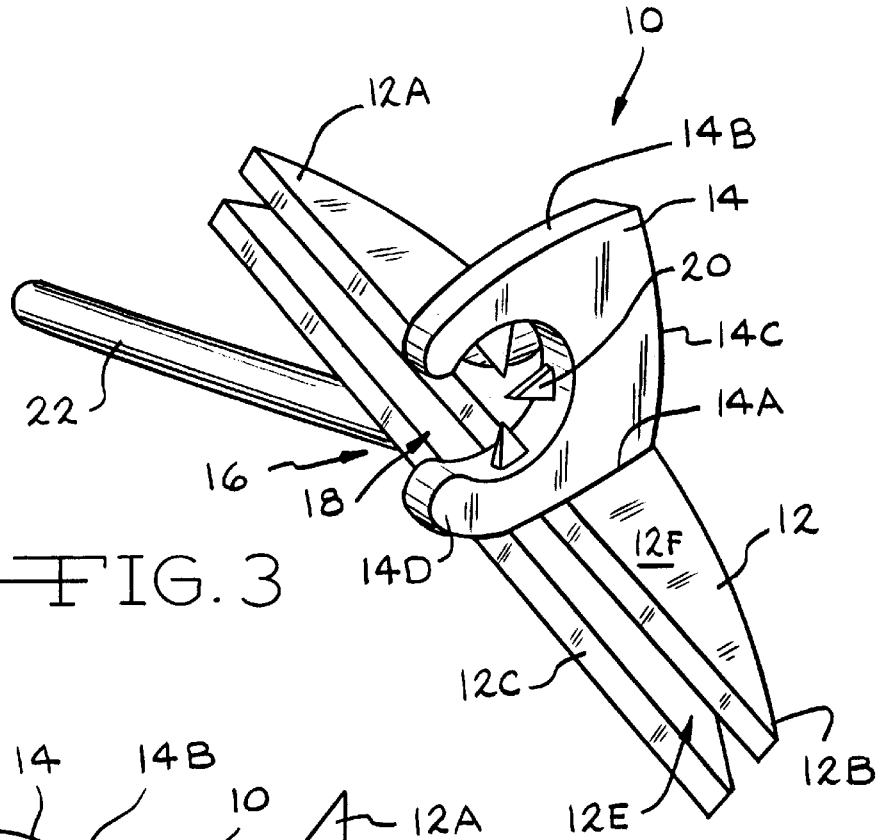
FIG. 3 is a perspective view of the rear peep sight 10 viewed from the first side 12C of the body 12.
Figure 4:
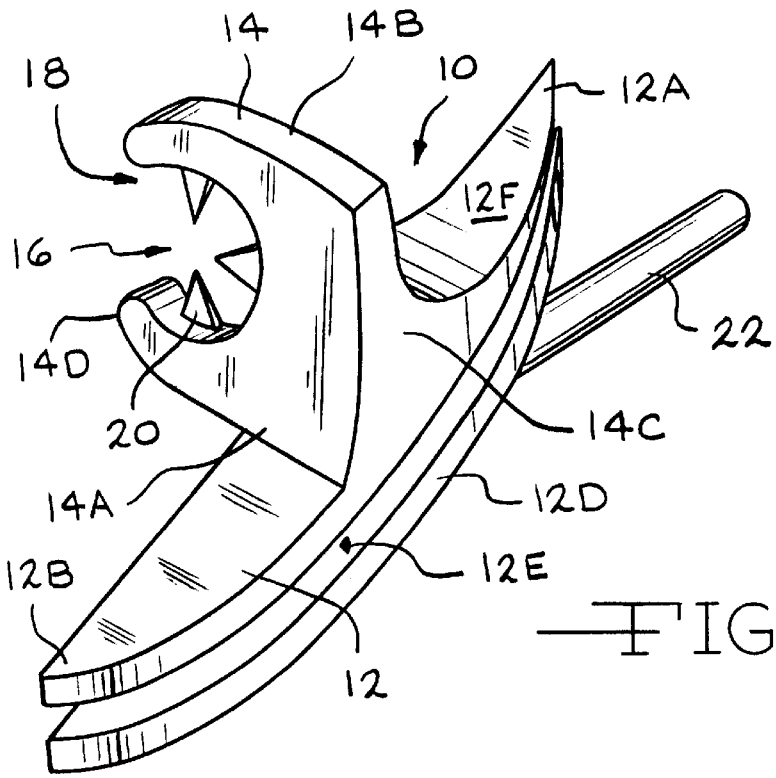
FIG. 4 is a perspective view of the rear peep sight 10 viewed from the second side 12D of the body 12.
Figure 5:
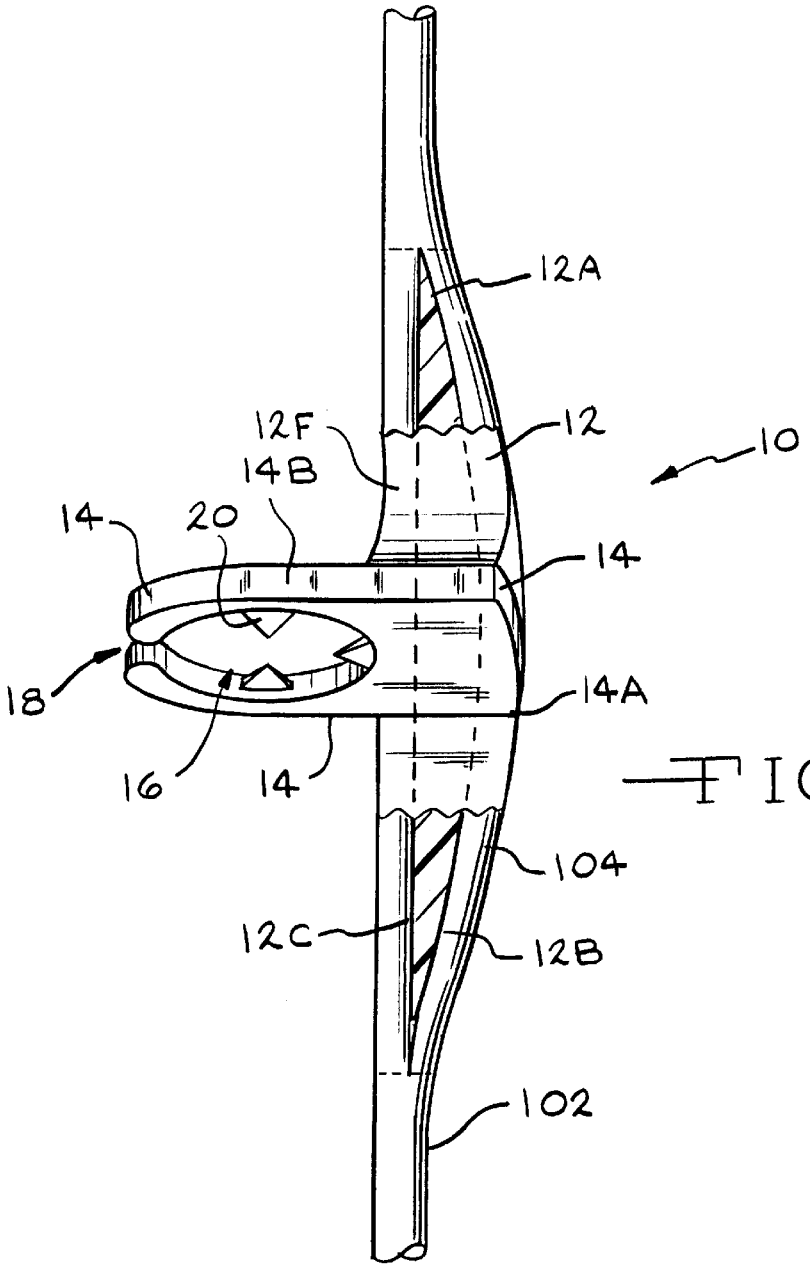
FIG. 5 is a top view of the rear peep sight 10 mounted between the strings 104 of the bowstring 102.

FIGS. 3 and 4 show the rear peep sight 10 of the present invention. The sight 10 includes a body 12, a sighting member 14 and an aligning post 22. The body 12 has a first end 12A and a second end 12B with first and second sides 12C and 12D extending therebetween. The sides 12C and 12D preferably converge at a point at each end 12A and 12B of the body 12. The first side 12C of the body 12 is preferably straight between the ends 12A and 12B. The second side 12D of the body 12 is preferably curved outward in an arc such that the body 12 is essentially D-shaped. Each of the sides 12C and 12D of the body 12 is provided with a groove 12E which accommodates at least one string 104 of a bowstring 102 of the archery bow 100 (FIG. 5). The grooves 12E divide the body 12 into a first surface 12F and a second surface 12G formed between the ends 12A and 12B and sides 12C and 12D of the main body 12. In the preferred embodiment, the body 12 has a length of 1.25 inches (3.18 cm) between the ends 12A and 12B. The grooves 12E preferably have a maximum depth of 0.0938 inches (0.2383 cm) at the midpoint of the body 12 which tapers to a minimum depth of 0.0313 inches (0.0795 cm) at the ends 12A and 12B of the body 12. The body 12 preferably has a thickness of 0.22 inches (0.56 cm) between the first surface 12F and the second surface 12G.

Figure 2:
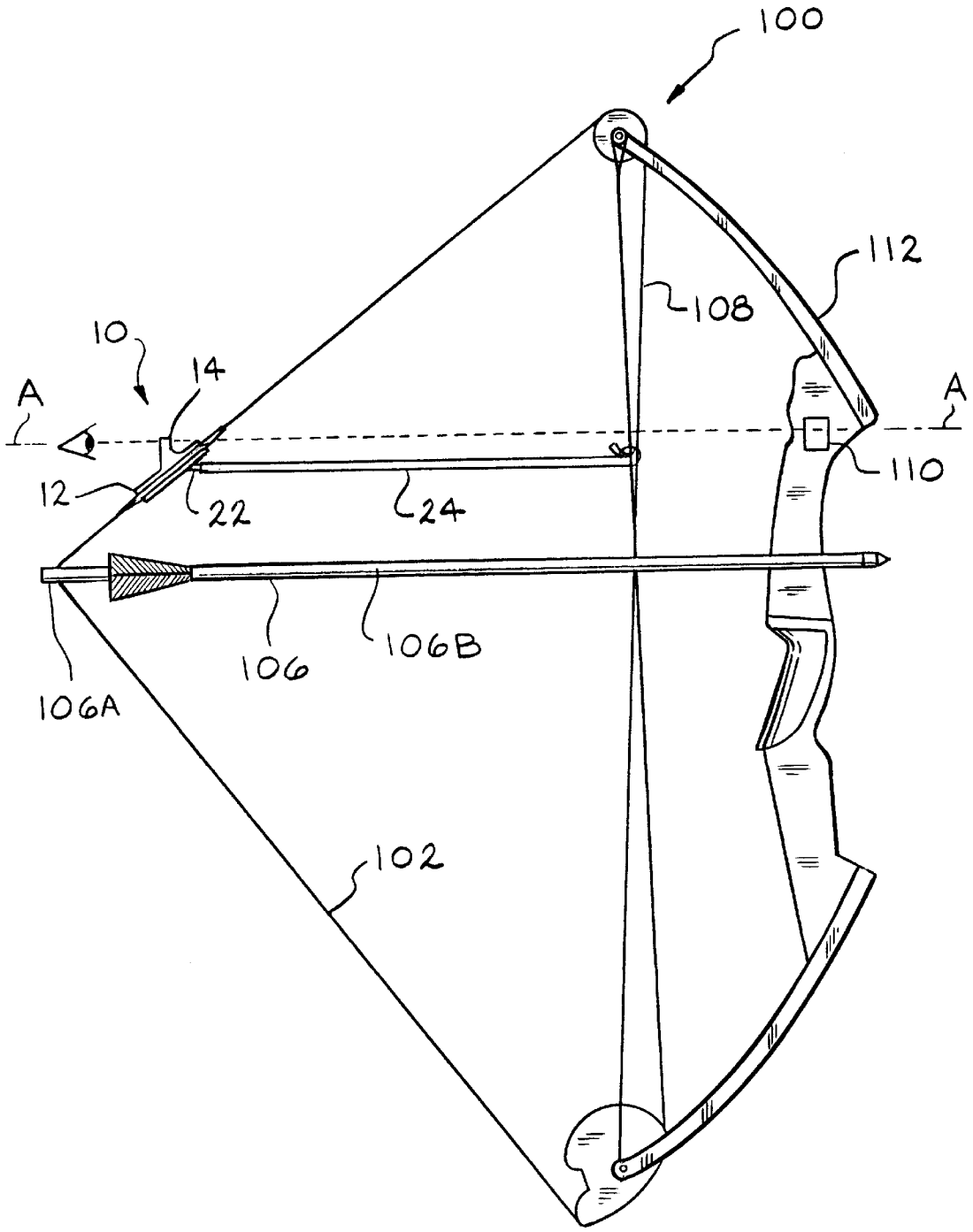
FIG. 2 is a side view of the archery bow 100 with the bowstring 102 in the fully drawn position showing the line of sight A—A through the rear peep sight 10.
Figure 6:
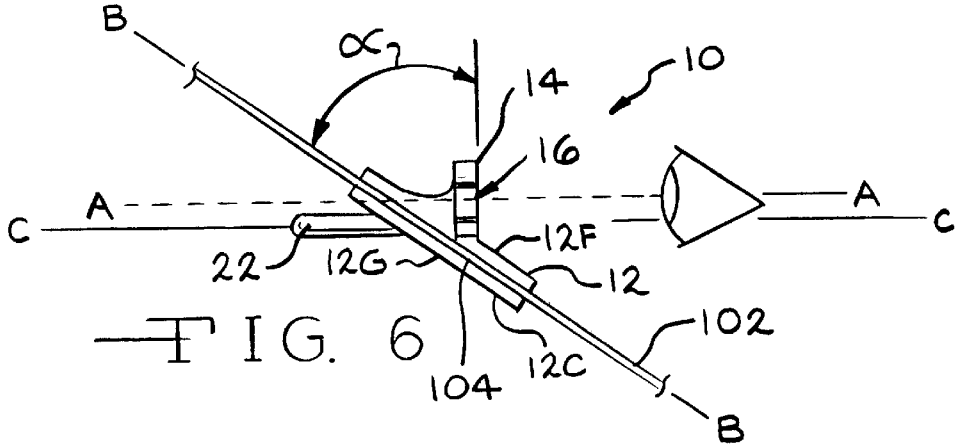
FIG. 6 is a side view of the rear peep sight 10 mounted on the bowstring 102 showing the line of sight A—A through the rear peep sight 10 when the bowstring 102 is in the fully drawn position and the angle $\alpha$ of the sight opening 16 to the bowstring 102 when the bowstring 102 is in the fully drawn position.

The sighting member 14 is located on the first surface 12F of the body 12 (FIGS. 3 and 4). The sighting member 14 includes a first end 14A and a second end 14B with a first side 14C and a second side 14D spaced therebetween. The sighting member 14 is positioned such that the first end 14A is adjacent to and in contact with the first surface 12F of the body 12 and the first side 14C of the sighting member 14 is adjacent the second side 12D of the body 12. The sighting member 14 is preferably evenly spaced between the ends 12A and 12B of the body 12 of the sight 10. However, it is understood that the positioning of the sighting member 14 on the body 12 can be altered depending on the position of the sight 10 on the bowstring 102 and the positioning of the sight opening 16 in the sighting member 14 (to be described in detail hereinafter). The sighting member 14 extends upward at an angle toward the first end 12A of the body 12. In the preferred embodiment, the angle a between the plane formed by the ends 14A and 14B of the sighting member 14 and the bowstring 102 is about 35° (FIG. 6). In the preferred embodiment, when the sight 10 is mounted between the strings 104 of the bowstring 102, the plane of the body 12 of the sight 10 between the ends 12A and 12B is parallel to the plane B—B formed by the bowstring 102. The sighting member 14 is mounted such that when the bowstring 102 is in the fully drawn position, a line of sight A—A through the center of the sight opening 16 and to the front sight 110 is parallel to the arrow 106 correctly mounted in the bow 100 (FIG. 2). The sighting member 14 extends outward from the first side 12C adjacent the second side 12D of the body 12 toward the second side 14D beyond the first side 12C of the body 12. The sighting member 14 extends the entire width of the body 12 and extends beyond the first side 12C of the body 12. The sighting member 14 preferably extends upward about 0.5625 inches (1.4288 cm). The sighting member 14 preferably extends beyond the first side 12C of the body 12 about 0.375 to 0.500 inches (0.953 to 1.27 cm).

The sighting member 14 is provided with a peep or sight opening 16 adjacent the second side 14D of the sighting member 14 and spaced between the ends 14A and 14B of the member 14 adjacent the second side 14D of the member 14 (FIGS. 3 and 4). The opening 16 is preferably spaced an equal distance from the ends 14A and 14B of the sighting member 14. However, the opening 16 could be positioned closer to one of the ends 14A or 14B depending on the positioning of the sight 10 on the bowstring 102. In the preferred embodiment, the inner most edge of the opening 16 is flush or even with the first side 12C of the body 12 (FIG. 5). The opening 16 is preferably provided with a gap 18 in the second side 14D of the sighting member 14. In the preferred embodiment, the opening 16 has a semi-circular shape. However, the opening 16 could have a variety of different shapes such as square or oval. The preferred semi-circular shape of the opening 16 allows the user to continue to view the opening 16 as a full circle while allowing additional light to enter the opening 16. By using a relatively small gap 18, the integrity of the circle remains. In the preferred embodiment, the opening 16 has a diameter of about 0.14625 to 0.2812 inches (0.3715 to 0.7142 cm) and the distance across the gap 18 is about 0.1875 inches (0.4763 cm). The opening 16 is preferably provided with aligning points or ticks 20 which extend inward toward the center of the opening 16. The points 20 preferably have a triangular shape with the apex of the triangle pointing inward toward the center of the opening 16. In the preferred embodiment, there are three (3) points 20 evenly spaced in the opening 16. Preferably, the points 20 are only lightly attached to the opening 16 such that the points 20 can be permanently removed. The points 20 are preferably of such a height as to outline the center of the opening 16 but not such as to meet in the center of the opening 16. In the preferred embodiment, the points 20 extend inward 0.0781 inches (0.1984 cm).

The aligning post 22 is mounted on the second surface 12G of the body 12 and extends outward away from the first side 12C of the body 12. The aligning post 22 extends outward perpendicular to the plane formed by the sighting member 14 (FIG. 6). In the preferred embodiment, the post 22 extends outward about 0.6250 inches (1.5875 cm). The aligning post 22 is mounted such that when the sight 10 is in the aligned position with the bowstring 102 fully drawn, the axis C—C of the post 22 is aligned with the line of sight A—A of the user (FIG. 6).

An aligning tether 24 is connected at one end to the aligning post 22 and is connected at the other end to the cable 108 or the riser 112 (FIG. 1). The tether 24 is preferably a flexible hollow tube which slips over the aligning post 22 such as to be friction fit on the post 22. The other end of the tether 24 can be connected to the cable 108 or riser 112 by any well known means such as by tying. The tether 24 is preferably constructed of a resilient material such as rubber. The tether 24 is of such a length that when the bowstring 102 is moved into the fully drawn position, the tether 24 is pulled taut such that the tether 24 moves the sight 10 into the aligned position (FIG. 2). The aligning post 22 and tether 24 are preferably similar to those well known in the art. It is understood that any type of aligning system could be used to position the sight 10. The body 12, sighting member 14 and aligning post 22 are preferably constructed as an integral piece. In the preferred embodiment, the sight 10 is constructed of plastic. However, the sight 10 can be constructed of any well known material that is lightweight and durable.

FIGS. 1 and 2 show the peep sight 10 mounted on a bow 100 having a multiple string, bowstring 102. The rear peep sight 10 is intended to be used to allow for aiming and aligning the arrow 106 with a target (not shown). The rear peep sight 10 is used in conjunction with a front sight 110 mounted on the riser or handle 112 of the bow 100. The sight 10 is preferably used with a compound bow such as those commonly used for hunting. However, the sight 10 can be used with any type of bow 100 having a multiple string, bowstring 102.

The peep sight 10 is mounted on the bowstring 102 such that the individual strings 104 of the bowstring 102 are positioned in the grooves 12E along the sides 12C and 12D of the body 12. The sight 10 is preferably positioned such that an equal number of strings 104 extend along each groove 12E. The sight 10 is positioned such that the first end 12A of the body 12 is adjacent the top of the bowstring 102. The sight 10 is positioned above the midpoint on the bowstring 102 such that the sight 10 is above the arrow 106 when the arrow 106 is positioned in the bowstring 102 (FIG. 2).

The sight 10 is positioned such that the opening 16 in the sighting member 14 is on the same side of the bowstring 102 as the user's aligning eye. The preferred embodiment shows a sight 10 to be used by a right handed user. However, the sight 10 could be designed for left handed users. The sight 10 is preferably secured between the strings 104 of the bowstring 102 by tying off the strings 104 adjacent each end 12A and 12B of the body 12. However, the sight 10 can be secured between the strings 104 by any well known means. When the sight 10 is mounted on the bowstring 102, the individual strings 104 mounted along the first side 12C of the body 12 are flush with the first side 12C of the body 12 and do not extend outward such as to interfere with the line of sight A—A through the opening 16 (FIG. 5). Once the sight 10 is secured in place on the bowstring 102, the tether 24 is then connected onto the post 22 and is mounted on the other end to the bow 100 or cable 108.

In use, the user (not shown) loads an arrow 106 in the bow 100 such that the nock 106A of the arrow 106 engages the bowstring 102 below the sight 10 (FIG. 2) and the shaft 106B extends outward toward the riser 112 of the bow 100. To aim the arrow 106, the user moves the bowstring 102 into the fully drawn position. As the bowstring 102 is drawn, the tether 24 on the aligning post 22 becomes taut and pivots the sight 10 on the bowstring 102 such that the tether 24 and aligning post 22 are parallel to the arrow 106. In this position, the sighting member 14 is perpendicular to the arrow 106 and the line of sight A—A through the opening 16 is parallel with the arrow 106. The user then sights the target (not shown) through the opening 16 in the sighting member 14 and aligns the front sight 110 with the target. If the aligning points 20 are provided in the opening 16, the user can use the points 20 to accurately position the front sight 110 and the target in the center of the opening 16. Due to the gap 18 in the opening 16, more light is able to enter the opening 16. This allows the user to accurately align the arrow 106 even in low light conditions, such as early evening and early morning. The size of the gap 18 allows the opening 16 to continue to appear as a full circle to allow for easier alignment by the user.

It is intended that the foregoing description be only illustrative of the present invention and that the present invention be limited only by the hereinafter appended claims.

We claim:

1. A rear sight for mounting on a bowstring of an archery bow for sighting a target, which comprises:

(a) a body having opposed ends with a first side and a second side extending therebetween with a first surface and a second surface between the sides and having a mounting means for mounting the sight on the bowstring wherein the sight is mounted on the bowstring such that the bowstring extends alone the sides of the body of the sight;

(b) a sighting means having opposed ends with an opening between the ends and positioned at one of the ends on the first surface of the body and extending outward at an angle away from the first surface in a direction opposite the second surface and extending outward away from the first side of the body and beyond the second side of the body such that the opening of the sighting means is beyond the second side of the body of the sight and beyond the bowstring extending along the second side of the body of the sight; and (c) an alignment means located on the body for positioning the sighting means in an aligned position such that when the bow is in a fully drawn position, a line of sight is allowed through the opening in the sighting means to the target.

2. The sight of claim 1 wherein the second side of the body is straight such that the body of the sight does not interfere with the line of sight through the opening.

3. The sight of claim 1 wherein the first and second sides of the body have a groove between the first and second surfaces extending between the ends of the body which provides the mounting means for the body for the sight, wherein the bowstring includes at least two strings and wherein the body is mounted on the bowstring such that at least one string of the bowstring extends along each of the grooves in the sides of the body.

4. The sight of claim 1 wherein the opening of the sighting means has a semi-circular shape.

5. The sight of claim 4 wherein the opening has a gap through a side of the sighting means between the ends of the sighting means.

6. The sight of claim 1 wherein the alignment means is a post located on the second surface of the body which extends outward from the second surface of the body in a direction opposite the first surface of the body at an angle such that a longitudinal axis of the post is perpendicular to a longitudinal axis of the sighting means between the ends.

7. The sight of claim 6 wherein the alignment means includes a tether having opposed ends which connects at one end on an end of the post opposite the body of the sight and wherein the other end of the tether is to be secured to a cable of the bow such that when the bowstring is moved into the fully drawn position, the tether becomes taut and pivots the sight into the aligned position.

8. The sight of claim 1 wherein the sighting means is positioned at between about a 30° and 40° angle with respect to the first surface of the body.

9. The sight of claim 1 wherein the opening of the sighting means has alignment points for accurately aligning the sight.

10. A rear sight for mounting on a bowstring of an archery bow for sighting a target, which comprises:

(a) a body having opposed ends with a first side and a second side extending therebetween with a first surface and a second surface and having a mounting means for mounting the sight on the bowstring;

(b) a sighting means having opposed ends with opposed first and second sides therebetween and positioned at one of the ends adjacent the first side of the body on the first surface of the body and extending outward toward the other end at an angle away from the first surface in a direction opposite the second surface and extending outward toward the second side of the body away from the first side of the body and beyond the second side of the body such that the second side of the sighting means is beyond the body of the sight, the sighting means having an opening with a gap adjacent the second side of the sighting means between the ends; and (c) an alignment means located on the second surface of the body for positioning the sighting means such that when the bow is in a fully drawn position, the sides of the sighting means are perpendicular to a line of sight to the target through the opening in the sighting means.

11. The sight of claim 10 wherein the opening is spaced beyond the second side of the body away from the first side of the body.

12. The sight of claim 10 wherein the second side of the body is straight such that the body of the sight does not interfere with the line of sight through the opening.

13. The sight of claim 10 wherein the opening of the sighting means has a semi-circular shape.

14. The sight of claim 10 wherein the opening of the sighting means has alignment points for accurate positioning of the sight.

15. The sight of claim 10 wherein the alignment means is a post located on the second surface of the body which extends outward from the second surface of the body in a direction opposite the first surface of the body at an angle such that a longitudinal axis of the post is perpendicular to a longitudinal axis of the sighting means between the ends.

16. The sight of claim 15 wherein the alignment means includes a tether having opposed ends which connects at one end on an end of the post opposite the body of the sight and wherein the other end of the tether is to be secured to a cable of the bow such that when the bowstring is moved into the fully drawn position, the tether becomes taut and pivots the sight into the aligned position.

17. The sight of claim 10 wherein the sighting means is positioned at between about a 30° and 40° angle with respect to the first surface of the body.

18. The sight of claim 10 wherein the first and second sides of the body have a groove between the first and second surfaces extending between the ends of the body which provides the mounting means for the body of the sight, wherein the bowstring includes at least two strings and wherein the body is mounted on the bowstring such that at least one string of the bowstring extends along each of the grooves in the sides of the body.

19. A method for accurately sighting an arrow in an archery bow with a target, the bow having a front sight mounted on a riser portion of the bow, which comprises the steps of:

(a) providing a rear sight for mounting on a bowstring of an archery bow, which comprises: a body having opposed ends with a first side and a second side extending therebetween with a first surface and a second surface between the sides and having a mounting means for mounting the sight on the bowstring wherein the sight is mounted on the bowstring such that the bowstring extends alone the sides of the body of the sight; a sighting means having opposed ends with an opening between the ends and positioned at one of the ends on the first surface of the body and extending outward at an angle away from the first surface in a direction opposite the second surface and extending outward away from the first side of the body and beyond the second side of the body such that the opening of the sighting means is beyond the second side of the body of the sight and beyond the bowstring extending along the second side of the body of the sight; and an alignment means located on the body for positioning the sighting means in an aligned position such that a line of sight through the opening in the sighting means and the front sight to the target is allowed when the bow is in a fully drawn position;

(b) mounting the arrow in the bow such that the sighting means is positioned on the bowstring above the arrow;

(c) drawing the bowstring away from the riser portion of the bow into the fully drawn position; and (d) aligning the arrow with the target by looking through the rear sight and aligning the front sight and the target.

20. The method of claim 19 wherein the alignment means includes a post positioned on the second surface of the body which extends outward from the second surface of the body in a direction opposite the first surface of the body at an angle such that a longitudinal axis of the post is perpendicular to a longitudinal axis of the sighting means between the ends and a tether having opposed ends and connected at one end on an end of the post opposite the body of the sight and wherein the other end of the tether is secured to a cable of the bow and wherein as the bowstring is moved into the fully drawn position, the tether becomes taut and pivots the sight into the aligned position such that the line of sight through the opening in the sighting means is parallel to the longitudinal axis of the arrow between the ends of the arrow.

21. The method of claim 19 wherein in step (b), the rear sight is positioned such that the sighting means extends outward from the body and the bowstring in a direction toward a user's sighting eye such as to accommodate a right handed or left handed user.

22. The method of claim 19 wherein the opening has a gap through a side of the sight means such as to increase an amount of light through the opening and wherein the bow is used in low light conditions.

23. The method of claim 19 wherein the opening has aligning points which point toward a center of the opening and wherein in step (e), to align the arrow, the front sight is located in the center of the opening of the sighting means in a middle of the aligning points.

24. A method for accurately sighting an arrow in an archery bow with a target, the bow having a front sight mounted on a riser portion of the bow, which comprises the steps of:

(a) providing a rear sight for mounting on a bowstring of an archery bow, which comprises: a body having opposed ends with a first side and a second side extending therebetween with a first surface and a second surface and having a mounting means for mounting the sight on the bowstring; a sighting means having opposed ends with opposed first and second sides therebetween and positioned at one of the ends adjacent the first side of the body on the first surface of the body and extending outward toward the other end at an angle away from the first surface in a direction opposite the second surface and extending outward toward the second side of the body away from the first side of the body and beyond the second side of the body such that the second side of the sighting means is beyond the body of the sight, the sighting means having an opening with a gap adjacent the second side of the sighting means between the ends; and an alignment means located on the second surface of the body for positioning the sighting means such that when the bow is in a fully drawn position, the sides of the sighting means are perpendicular to a line of sight allowed through the opening in the sighting means and the front sight to the target;

(b) mounting the arrow in the bow such that the sighting means is positioned on the bowstring above the arrow;

(c) drawing the bowstring away from the riser portion of the bow into the fully drawn position; and (d) aligning the arrow with the target by looking through the rear sight and aligning the front sight and the target.

25. The method of claim 24 wherein the opening has aligning points which point toward a center of the opening and wherein in step (e), to align the bow, the front sight is located in the center of the opening of the sighting means in a middle of the aligning points.

26. The method of claim 24 wherein in step (b), the rear sight is positioned such that the sighting means extends outward from the body and the bowstring in a direction toward a user's sighting eye such as to accommodate a right handed or left handed user.

27. A rear sight for mounting on a bowstring of an archery bow for sighting a target, which comprises:

(a) a body having opposed ends with a first side and a second side extending therebetween with a first surface and a second surface between the sides and having a mounting means for mounting the sight on the bowstring wherein the body is mounted on the bowstring such that the bowstring extends along the sides of the body;

(b) a sighting means having opposed ends with an opening between the ends and positioned at one of the ends on the first surface of the body and extending outward at an angle away from the first surface in a direction opposite the second surface and extending outward away from the first side of the body and beyond the second side of the body such that the opening of the sighting means is beyond the second side of the body of the sight and beyond the bowstring extending along the second side of the body of the sight; and (c) an alignment means for positioning the sighting means in an aligned position such that when the bow is in a fully drawn position, a line of sight is allowed through the opening in the sighting means to the target.

* * * * *